US006572366B2

(12) United States Patent
Eroglu et al.

(10) Patent No.: US 6,572,366 B2
(45) Date of Patent: Jun. 3, 2003

(54) BURNER SYSTEM

(75) Inventors: Adnan Eroglu, Untersiggenthal (CH); Klaus Knapp, Gebenstorf (CH); Bettina Paikert, Oberrohrdorf (CH)

(73) Assignee: Alstom (Switzerland) Ltd, Baden (CH)

( * ) Notice: Subject to any disclaimer, the term of this patent is extended or adjusted under 35 U.S.C. 154(b) by 0 days.

(21) Appl. No.: 10/145,044

(22) Filed: May 15, 2002

(65) Prior Publication Data

US 2002/0187448 A1 Dec. 12, 2002

(30) Foreign Application Priority Data

Jun. 9, 2001 (DE) ..... 101 28 063

(51) Int. Cl.[7] ..... F23D 14/46

(52) U.S. Cl. ..... 431/350; 431/353; 431/182; 431/185

(58) Field of Search ..... 431/350, 351, 431/353, 8, 9, 354, 182, 185; 60/748, 737, 464, 743

(56) References Cited

U.S. PATENT DOCUMENTS

| | | | | |
|---|---|---|---|---|
| 5,433,596 A | * | 7/1995 | Dobbeling et al. | 431/350 |
| 5,593,302 A | * | 1/1997 | Althaus et al. | 431/350 |
| 5,829,967 A | * | 11/1998 | Chyou | 431/350 |
| 6,141,967 A | | 11/2000 | Angel et al. | |

FOREIGN PATENT DOCUMENTS

| | | |
|---|---|---|
| DE | 196 39 301 | 3/1998 |
| DE | 196 40 198 | 4/1998 |
| DE | 198 09 364 | 9/1998 |
| DE | 197 36 902 | 3/1999 |
| EP | 0619133 A1 | 10/1994 |
| EP | 0623786 A1 | 11/1994 |

* cited by examiner

*Primary Examiner*—James C. Yeung
(74) *Attorney, Agent, or Firm*—Burns, Doane, Swecker & Mathis, L.L.P.

(57) ABSTRACT

What is described is a burner system with a premix burner (1), in which is provided at least one vortex generator (2), through which passes an air-containing gaseous main flow (ZL) which flows axially through the premix burner (1) and into which gaseous and/or liquid fuel is injected, downstream of the vortex generator (2), as a secondary flow for generating a fuel/air mixture, and with a combustion chamber (5) which adjoins the premix burner (1) downstream of the latter and has a combustion chamber cross section (C2) which is larger than the flow cross section (C1), delimited by the premix burner (1), directly upstream of the combustion chamber (5). The invention is distinguished in that, between the premix burner (1) and the combustion chamber (5), a flow duct (10) is provided, delimited by side walls which create a gradual transition between the flow cross section (C1) and the combustion chamber cross section (C2), and in that upstream, within and/or downstream of the flow duct (10) is provided at least one flow stall structure (11), by means of which the fuel/air mixture passing through the flow duct (10) is separated locally from the side wall of the flow duct (10).

8 Claims, 2 Drawing Sheets

BURNER SYSTEM

FIELD OF THE INVENTION

The invention relates to a burner system with a premix burner, in which is provided at least one vortex generator, through which passes an air-containing gaseous main flow which flows axially through the premix burner and into which gaseous and/or liquid fuel is injected, downstream of the vortex generator, as a secondary flow for generating a fuel/air mixture, and with a combustion chamber which adjoins the premix burner downstream of the latter and has a combustion chamber cross section which is larger than the flow cross section, delimited by the premix burner, directly upstream of the combustion chamber.

BACKGROUND OF THE INVENTION

A generic burner system referred to above may be understood, for example, from EP 0 623 786 B1 and is designed for purposes of optimized intermixing between a fuel mass flow and a supply-airflow. A generic burner system of this type is illustrated diagrammatically in FIG. 3. The known burner system has a premix burner 1 through which a supply-airstream ZL flows axially. The supply air ZL, which, as a rule, is compressed by a compressor stage, first flows through a vortex generator 2, for example of the type of the vortex generator described in EP 0 619 133 B1. The vortex generator 2 typically consists of four tetrahedrally designed vortex bodies which, distributed equally in the circumferential direction, are arranged within the flow duct. A vortex generator 2 constructed in this way can generate in each case four pairs of vortex flows which are propagated downstream within the premix burner 1. Gaseous or liquid fuel is injected centrally into the swirled supply air ZL preferably via an axially mounted fuel lance 3 which is arranged downstream of the vortex generator 2 within the premix burner 1. The fuel is intermingled, along the mixing zone 4 extending downstream, essentially uniformly with the swirled supply air ZL, to form a fuel/air mixture which finally, in the direction of flow, enters a combustion chamber 5 downstream of the premix burner 1 and is ignited.

The flow transition within the burner system illustrated in FIG. 3 is stepped in a way known per se, that is to say the flow cross section C1 located through the premix burner 1 in the mixing region 4 is directly contiguous, via a sharp-edged step 6, to the widened combustion chamber cross section C2. This abrupt transition between the premix burner 1 and the combustion chamber 5 leads in terms of flow, within the fuel/air mixture propagated axially, to what are known as separation vortices 7 which are propagated downstream of the sharp-edged step 6 and which have a considerable vortex intensity oriented transversely to the direction of propagation and are formed in a periodic sequence. Those very separation vortices 7 lead, under specific operating conditions, to combustion instabilities which result in a pulsating release of heat, primarily within the cross vortices which are formed along the shear layer. Moreover, pulsating releases of heat of this kind cause the formation of thermoacoustic vibrations within the combustion chamber which not only have extremely adverse effects on combustion, but also have the effect of exerting a high mechanical load on all the housing components of the burner system. Thermoacoustic vibrations are, basically, resonant phenomena which are formed to a greater or lesser extent in specific operating states of the burner system, but occur intensively, in particular, at relatively low inlet or flame temperatures.

A further disadvantage of the sharp-edged transition between the premix burner 1 and the combustion chamber 5 is inadequate utilization of the entire combustion chamber volume, especially since large volume parts 8 within the combustion chamber 5 are regularly shaded off and are therefore not available for the combustion operation. Investigations on burner systems known per se have shown that what may be referred to as the reapplication point 9, at which the swirled shear layer is applied to the inner wall of the combustion chamber 5 downstream of the sharp-edged step 6, is at a distance from the step 6 which corresponds to up to seven times the combustion chamber diameter. It is also to be observed that the reapplication point 9 behaves asymmetrically in the circumferential direction in relation to the combustion chamber 5.

SUMMARY OF THE INVENTION

The object is, therefore, to improve an above-described generic burner system to the effect that the combustion process within the combustion chamber is optimized. The question is, in particular, to utilize the combustion chamber volume virtually completely for the combustion of the fuel/air mixture entering the combustion chamber. The question is, furthermore, to take measures which serve for preventing the thermoacoustic vibrations occurring within the combustion chamber. The precautions to be taken are, on the one hand, to be capable of being achieved by as simple a means as possible and incur only low costs. The question, also, is to integrate the precautions into already existing burner systems which are in operation.

The solution for achieving the object on which the invention is based is specified in claim 1. Advantageous features are the subject matter of the subclaims and may be gathered from the following description, with reference to the figures.

According to the invention, a burner system is designed in such a way that, between the premix burner and the combustion chamber, a flow duct is provided, delimited by side walls which create a gradual transition between the flow cross section (C1) and the combustion chamber cross section (C2), and that upstream, within and/or downstream of the flow duct is provided at least one flow stall structure, by means of which the fuel/air mixture passing through the flow duct is separated locally from the side wall of the flow duct.

In contrast to the sharp-edged transition between the premix burner and the combustion chamber, as illustrated in FIG. 3, the burner system designed according to the invention has a gradual transition between the premix burner and the combustion chamber, said transition preferably having a rounded design. The term "gradual transition" is intended to mean basically any transitional geometry which widens the flow cross section within the premix burner, which is dimensioned smaller than that within the combustion chamber, successively to the combustion chamber cross section. Ideally, the transition has a funnel-shaped contour, by means of which the flow cross section within the premix burner is widened uniformly to the combustion chamber cross section. It is likewise also possible to design the transitional region conically, that is to say with side walls obliquely inclined rectilinearly to the direction of flow. A segmented line-up of rectilinearly designed side wall portions or multiply stepped transitional structures may basically also be envisaged.

By a gradual transition being provided between the premix burner and the combustion chamber, the widening of the fuel/air mixture entering the combustion chamber is increased considerably, the result of this being, even in the case of a gradual transition, that a marginal flow having cross vortices is formed, which, however, impinges on to the combustion chamber wall at a reapplication point which is very much nearer in the direction of the premix burner than in the case of a sharp-stepped transition according to the known burner system illustrated in FIG. 3. This has an advantageous effect on the combustion process in two respects. Thus, on the one hand, the marginal flow having cross vortices 7 is reduced, and therefore the intensity and number of the cross vortices 7 formed are also reduced, with the result that the combustion chamber pulsation generated by thermoacoustic vibrations can be decisively damped. On the other hand, by virtue of the markedly greater widening of the fuel/air mixture propagated within the combustion chamber, the dead space caused by shading-off effects is reduced to a minimum, with the result that virtually the entire combustion chamber volume is available for the combustion of the fuel/air mixture and ensures complete combustion of the fuel.

However, investigations on flow ducts with a gradual transition between a premix burner and a combustion chamber following downstream have yielded the result that, as a function of the flow conditions, periodically occurring flow breakaways arise in the circumferential direction of the flow duct in the region of the gradual transition and, in turn, have a disturbing effect as resonant phenomena in terms of the formation of thermoacoustic instabilities. In order to prevent this, in the region of the flow duct at least one flow stall structure is provided, by means of which circumferential coherence within the gradual transition is to be disturbed. This flow stall structure, which is arranged individually or in a number, preferably uniformly in the circumferential direction of the flow duct, defines a defined breakaway point or flow stall of the fuel/air mixture passing through the air duct, as a result of which the circumferential coherence is disturbed.

The flow stall structure is mounted on the side wall of the flow duct and has a stall edge which is arranged preferably at the flow outlet of the flow duct. Upstream of the stall edge, the flow stall structure has streamlined surface parts which fit snugly, upstream, against the side wall of the flow duct.

By the provision of flow stall structures of this type within the flow duct, the occurrence of coherent structures can be effectively counteracted.

BRIEF DESCRIPTION OF THE DRAWINGS

The invention is described below by way of example, without the general idea of the invention being restricted, by means of exemplary embodiments, with reference to the drawings in which.

Figure 2:
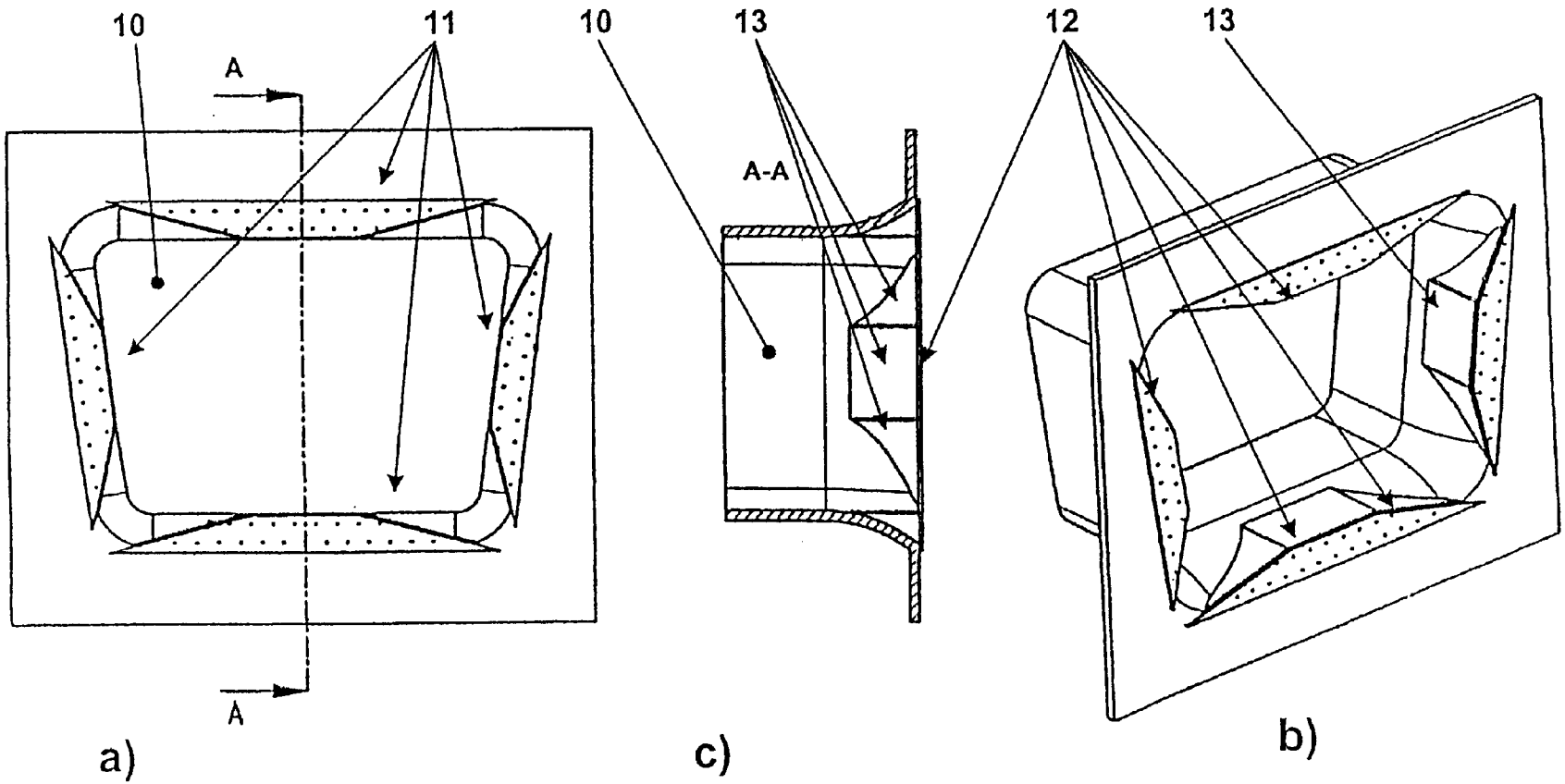
FIGS. 2*a–c* show a multiview illustration of a flow duct designed according to the invention, with flow stall structures.

The reference symbols introduced above in FIG. 2 are used in the same way to explain the following exemplary embodiment. A more detailed explanation of structurally identical components is dispensed with for the sake of avoiding repetition.

DETAILED DESCRIPTION OF THE INVENTION

Figure 1:
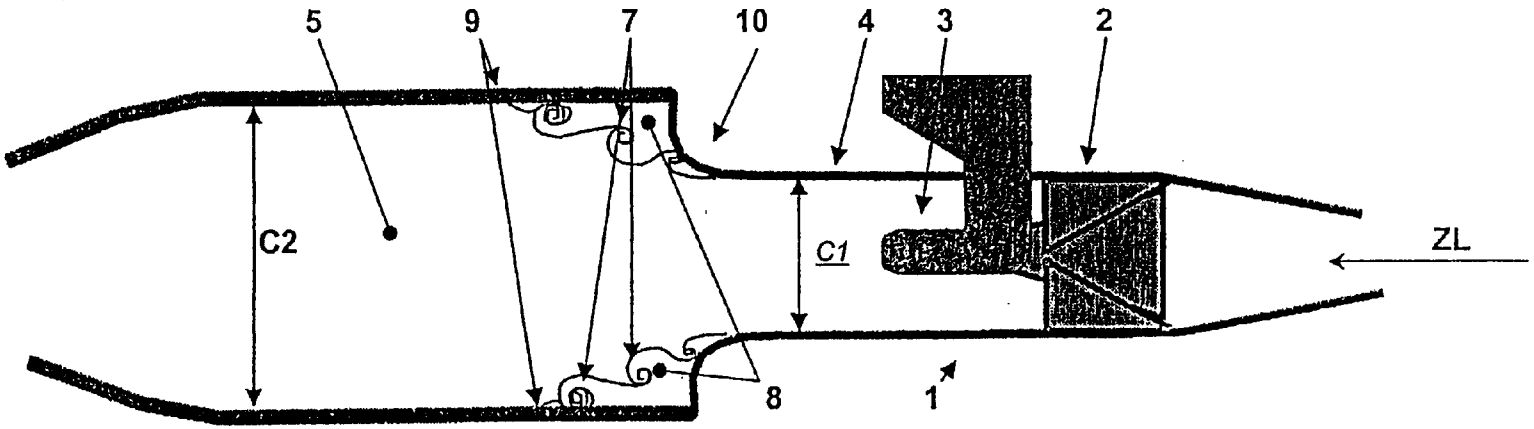
FIG. 1 shows a diagrammatic longitudinal section through a burner system designed according to the invention.
Figure 3:
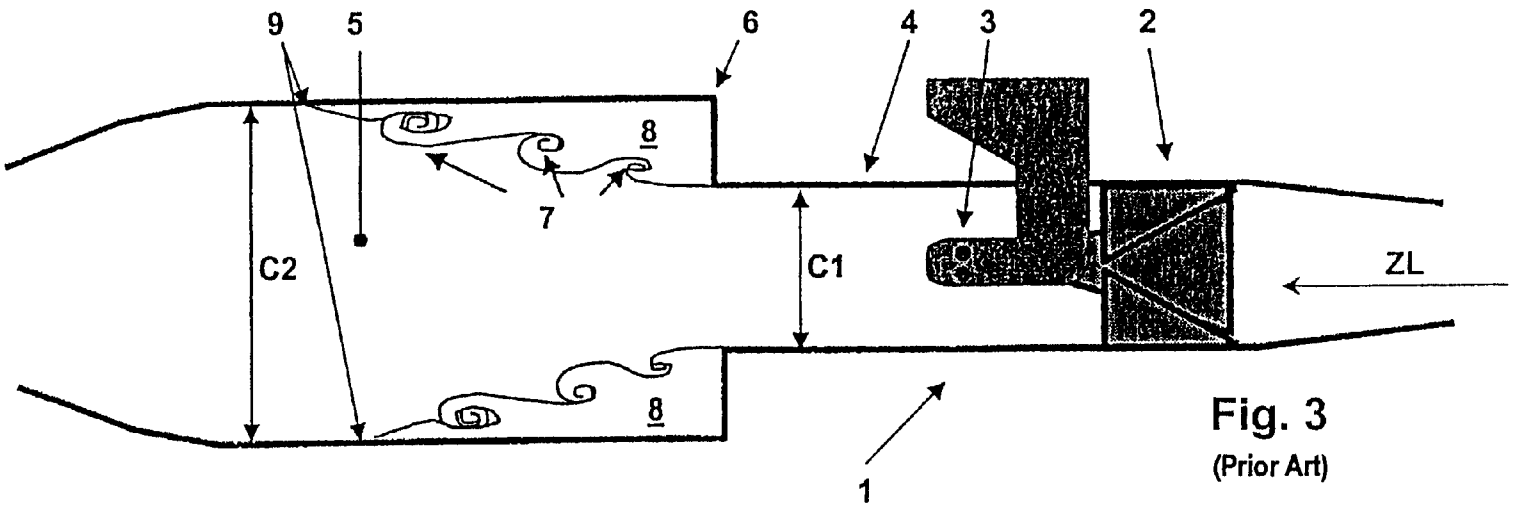
Fig. 3 (Prior Art)
FIG. 3 shows a known burner system (prior art).

FIG. 1 illustrates a diagrammatic longitudinal section through a burner system designed according to the invention, which provides, as a connection piece between the premix burner 1 and the combustion chamber 5, a flow duct 10, the side walls of which create a gradual transition between the flow cross section C1 within the premix burner and the combustion chamber cross section C2. The side walls of the flow duct 10 are designed to be uniformly curved, in a similar way to a funnel, and thus make it possible to have a continuous widening of the flow cross section. As a result, the reapplication point 9 is displaced upstream in the direction of the premix burner 1, with the result that the shade-induced dead space 8 is considerably reduced. Also, the shear layer containing cross vortices 7 is shortened markedly, with a considerably lower vortex intensity.

FIGS. 2*a–c* illustrate in several views variants of an advantageously designed flow duct 10 which can be integrated as an individual component in a modular manner into already existing burner systems.

FIG. 2*a* shows a view of the flow duct 10 upstream in the direction of the premix burner 1. Four flow stall structures 11, in each case with associated stall edges 12, are located directly at the flow outlet, illustrated in FIG. 2*a*, of the flow duct 10.

The flow stall structures 11 can be seen more clearly in their three-dimensional form from FIG. 2*b* which shows a perspective oblique view of the flow duct 10. The flow stall structures 11 are located, in the region of the gradual transition within the flow duct 10, directly at the side walls delimiting the flow duct 10 and in each case have, upstream of the stall edge 12, streamlined surface parts 13, by means of which the flow passing through the flow duct 10 is continuously deflected locally from the side walls. An actual flow breakaway takes place along the stall edge 12 of the respective flow stall structures. FIG. 2*c* illustrates a section illustration along the section AA depicted in FIG. 2*a*. Reference is made at this juncture to the corresponding reference symbols already referred to.

By the combination according to the invention of a flow duct interposed between the premix burner and combustion chamber and having a gradual transition and the provision of suitable flow stall structures which are arranged preferably symmetrically around the flow duct, the bum-up behavior of a generic burner system can be decisively optimized. The method according to the invention at the same time serves decisively for the damping of combustion chamber pulsations which are formed within the burner system.

List of reference symbols

What is claimed is:

1. A burner system, comprising:

a premix burner having at least one vortex generator, through which passes an air-containing gaseous main flow, the main flow flowing axially through the premix burner;

means for injecting gaseous and/or liquid fuel into the premix burner, said injecting means being arranged downstream of the vortex generator, as a secondary flow for generating a fuel/air mixture;

a combustion chamber arranged downstream of the premix burner, said combustion chamber having a cross section which is larger than a cross section of the flow, said flow cross section being defined as the cross section of the premix burner; and a flow duct arranged between the premix burner and the combustion chamber, said flow duct being delimited by side walls which create a gradual transition between the flow cross section and the combustion chamber cross section, and wherein upstream, within and/or downstream of the flow duct is provided at least one flow stall structure, by means of which the fuel/air mixture passing through the flow duct is separated locally from the side walls of the flow duct.

2. The burner system as claimed in claim 1, wherein the flow duct is delimited by side walls running rectilinearly obliquely to the axial direction of flow, rectilinearly segmented side wall portions or curved side walls.

3. The burner system as claimed in claim 1, wherein the flow stall structure locally reduces the flow cross section of the flow duct.

4. The burner system as claimed in claim 1, wherein a number of flow stall structures is provided at a flow outlet of the flow duct.

5. The burner system as claimed in claim 4, wherein the flow stall structures are arranged in a symmetric arrangement around the flow outlet of the flow duct.

6. The burner system as claimed in claim 1, wherein the flow stall structure has a stall edge which rises above a side wall of the flow duct.

7. The burner system as claimed in claim 6, wherein the stall edge projects into the flow duct to a depth which, in axial projection upstream, does not confine the flow cross section.

8. The burner system as claimed in claim 6, wherein the flow stall structure is mounted on the side wall of the flow duct and designed in such a way that, upstream of the stall edge, at least one flow-conducting surface part is provided, which connects the stall edge to a side wall of the flow duct, and wherein the stall edge is oriented perpendicularly to the direction of flow.

* * * * *